US005588184A

United States Patent [19]

Chen

[11] Patent Number: 5,588,184

[45] Date of Patent: Dec. 31, 1996

[54] BELT BUCKLE

[76] Inventor: Kuo-Jen Chen, No. 187, Hua Yin Street, Taipei, Taiwan

[21] Appl. No.: 604,023

[22] Filed: Feb. 20, 1996

[51] Int. Cl.[6] ..... A44B 11/00

[52] U.S. Cl. ..... 24/170; 24/171; 24/191

[58] Field of Search ..... 24/170, 171, 191, 24/163 R, 58.5, 265 WS

[56] References Cited

U.S. PATENT DOCUMENTS

| | | | |
|---|---|---|---|
| 644,095 | 2/1900 | Rausseau | 24/170 |
| 899,327 | 9/1908 | Rounds | 24/170 |
| 1,394,380 | 10/1921 | Wardner | 24/191 |
| 3,979,800 | 9/1976 | Masuda | 24/191 |
| 4,669,155 | 6/1987 | Chen | 24/170 |

*Primary Examiner*—Victor N. Sakran
*Attorney, Agent, or Firm*—Bacon & Thomas

[57] ABSTRACT

A belt buckle of the type including a buckle body, a belt catch holder pivoted to the buckle body, a serrate plate pivoted to the belt catch holder to hold down the fixed end of the belt, and a belt catch means for securing the free end of the belt to the buckle body, wherein the belt catch means includes a belt catch mounted in a recess on the belt catch holder, a compression spring mounted within the recess of the belt catch holder to force the belt catch into engagement with the serrate free end of the belt upon its insertion the belt slot of the buckle body, and a loop connected to the belt catch holder by a chain for holding the free end of the belt.

2 Claims, 4 Drawing Sheets

BELT BUCKLE

BACKGROUND OF THE INVENTION

The present invention relates to belt buckles, and relates more particularly to such a belt buckle which comprises a spring-supported belt catch for stopping the free end of the belt from reverse movement upon its insertion into the belt slot of the buckle body, and a loop connected to the belt catch holder of the belt buckle by a chain for holding the free end of the belt in place.

Regular belt buckles commonly have a locating pin raised from the buckle body for insertion into one of the longitudinal series of through holes at the free end of the belt to hold the belt in the fastened position. This structure of belt buckle does not allow the tightness of the belt to be adjusted stepless. Furthermore, the through holes of the belt tend to be deformed or ruptured after a tong use. U.S. Pat. No. 4,669,155 and British Patent No. 2,183,715 disclose an improved belt buckle which comprises a buckle body, a belt catch holder, a belt catch, a fastening plate, a spring plate, and a serrate plate, wherein the belt catch is fitted in a recess of the belt catch holder and joined together with the buckle body and the belt catch holder by means of knuckles and a pin so as to allow the belt to pass the slot in the buckle body freely and to catch the same as it retreats; the fastening plate is fitted in the space of the belt catch holder and jointed together with the belt catch holder by means of knuckle and pin so as to fasten the belt end; the spring plate is fixed to the fastening plate and engages one ratchet corner of the belt catch so that the other ratchet corner can move retractably; the serrate plate is mounted on the reverse of the belt for the belt catch to catch adjustably. The belt catching mechanism of this belt buckle is complicated. In order to keep the belt catch in the best engaging position, the spring plate must be properly adjusted by the user. Furthermore, the spring plate tends to be damaged or forced to deform when it is adjusted.

The embodiment of the disclosure of U.S. Pat. No. 899,327 entitled "HARNESS BUCKLES", comprises a back plate arranged for connection at one end with a harness strap, the other end having a slot and a cross bar, a spring-pressed lever fulcrumed and ranging lengthwise of the back plate, the lever having its free end extending into the slot for clamping the free end of the harness strap against the cross bar, and a hood on the back plate and extending over the lever to protect the same. This structure of harness buckle is functional, however it requires much installation space.

Furthermore, a belt may be equipped with a loop for holding the free end after its insertion into the belt slot of the buckle. Because the loop is simply sleeved onto the belt, it tends to slip out of the belt.

SUMMARY OF THE INVENTION

The present invention has been accomplished to provide a belt buckle which eliminates the aforesaid drawbacks. It is one object of the present invention to provide a belt catch means for stopping the free end of the belt from reverse movement after its insertion into the belt slot of the buckle body which is easy to install and durable in use. It is another object of the present invention to provide a loop for holding the free end of the belt after its insertion into the belt slot of the buckle body which is connected to the belt catch holder by a chain.

DETAILED DESCRIPTION OF THE PREFERRED EMBODIMENT

Figure 1:
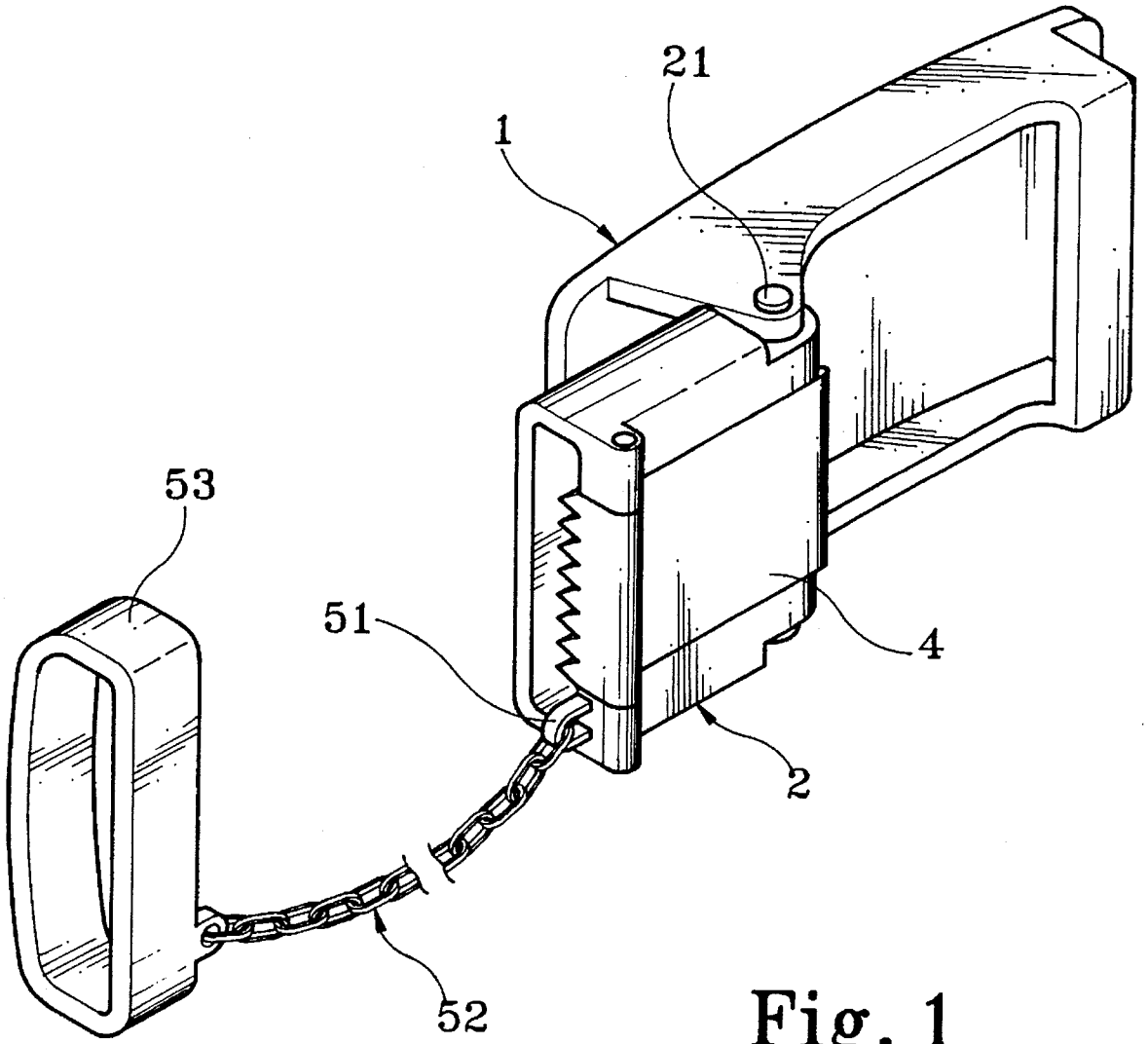
FIG. 1 is an elevational back side view of a belt buckle according to the present invention.
Figure 3:
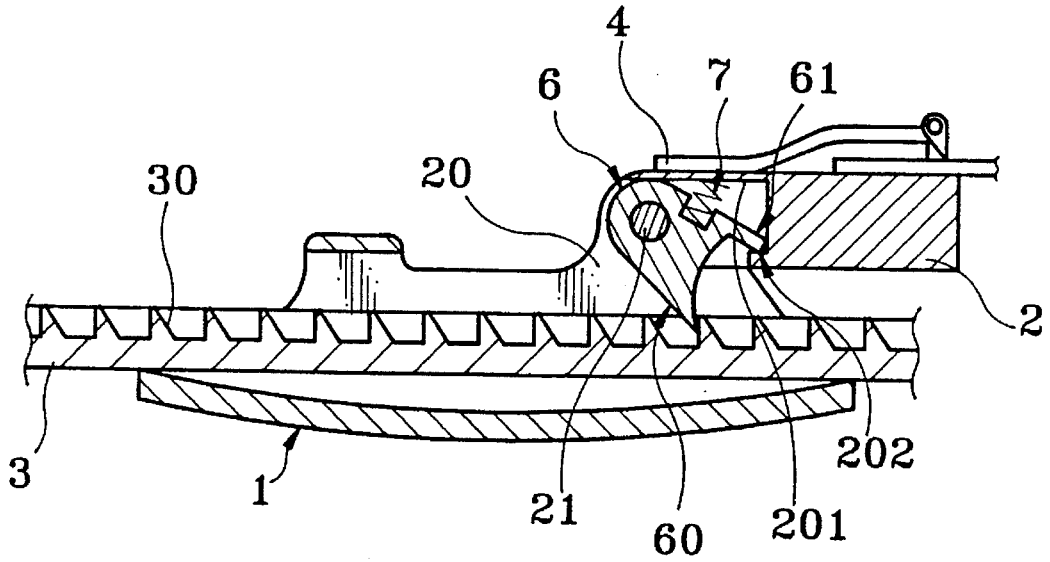
FIG. 3 is a sectional view of the belt buckle according to the present invention, showing the pawl of the belt catch forced into engagement with the transverse teeth of the free end of the belt.

Referring to FIGS. 1 and 3, a belt catch holder 2 is pivotably connected to a buckle body 1 by a pivot pin 21 for catching the tail (free) end of the belt 3, and a serrate plate 4 is pivotably connected to the belt catch holder 2 by a pivot pin 40 for holding down the lead (fixed) end of the belt 3. The belt 3 has a longitudinal series of transverse teeth 30 raised from the back side and sloping in one direction. A metal loop 53 is connected to a lug 51 on the belt catch holder 2 by a chain 52.

Figure 2:
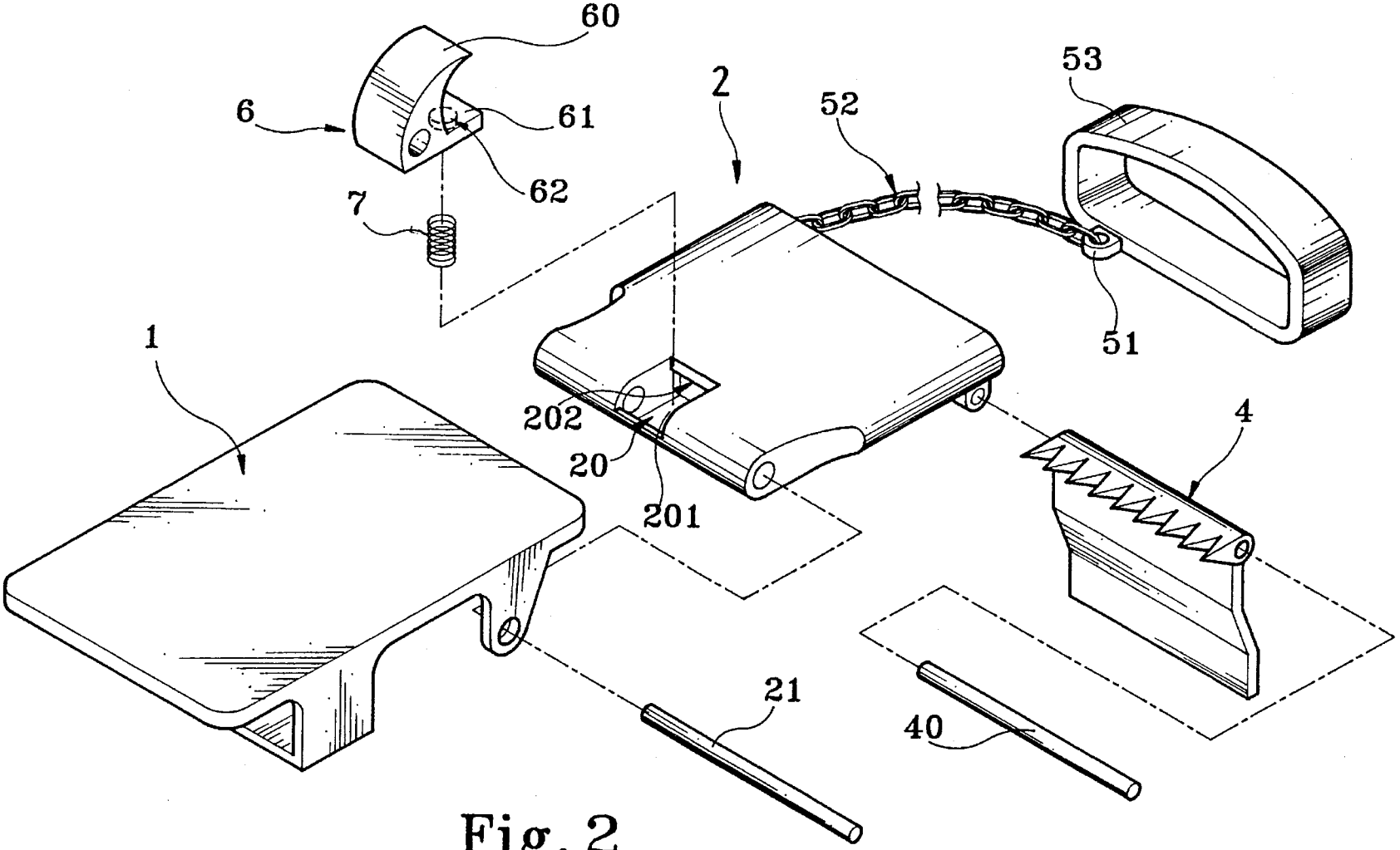
FIG. 2 is an exploded view of the belt buckle shown in FIG. 1.
Figure 4:
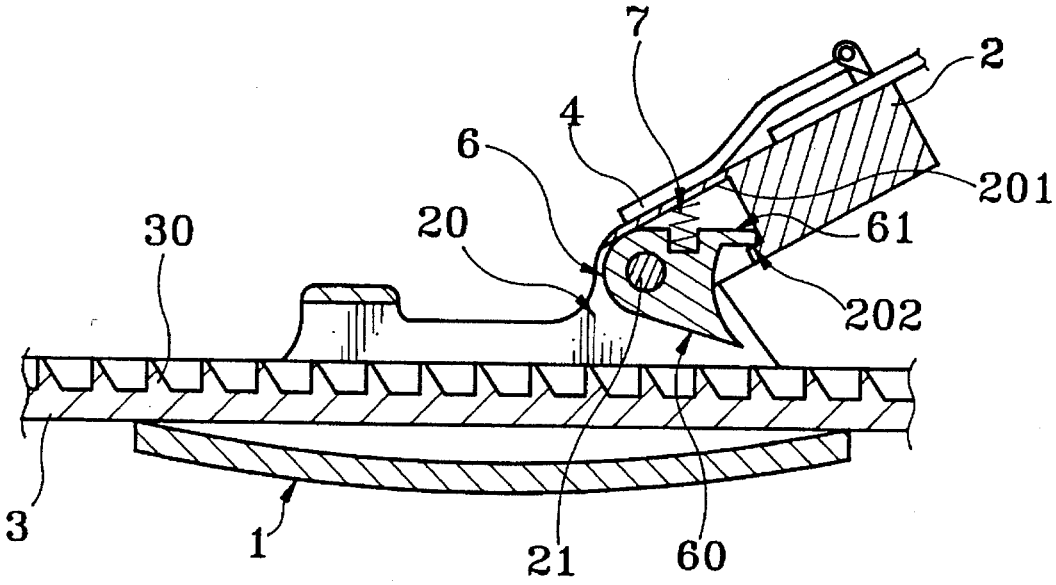
FIG. 4 is similar to FIG. 3, but showing the pawl of the belt catch disengaged from the belt.

Referring to FIGS. 2, 3, and 4, the buckle body 2 has a recess 20 through which the pivot pin 40 passes. A belt catch 6 is mounted in the recess 20 and turned about the pivot pin 40, having an arched pawl 60 for stopping against the transverse teeth 30 of the belt 3 and a stop wall 61. The arched pawl 60 curves in such a direction that the transverse teeth 30 can be moved over the arched pawl 60 upon the insertion of the belt 3. The buckle body 2 further comprises a horizontal rib 202 above the recess 20 for stopping against the stop wall 61 of the belt catch 6 to keep the arched pawl 60 of the belt catch 6 in a tilted position as shown in FIG. 3 so that the arched pawl 60 is forced into engagement with the transverse teeth 30 when the belt 3 is pulled backwards. Furthermore, a compression spring 7 is mounted within the recess 20 of the belt catch holder 2, having one end stopped at the bottom wall 201 of the recess 20 and an opposite end inserted into a bottom blind hole 62 on the belt catch 6. The bottom blind hole 62 of the belt catch 6 is disposed between the pivot pin 21 and the horizontal rib 202 when the belt catch 6 is installed. The compression spring 6 gives an outward pressure to the belt catch 6, causing it to force the pawl 60 into engagement with the transverse teeth 30.

During the assembly process, the compression spring 7 and the belt catch 6 are respectively put in the recess 20, and then the pivot pin 21 is installed to hold the buckle body 1, the belt catch holder 2, and the belt catch 6 together. Because the belt catch 6 is turned about the pivot pin 21 and supported on the compression spring 7, it does not escape out of place.

Referring to FIG. 4, the belt catch 6 can be conveniently disengaged from the belt 3 for permitting the free end of the belt 3 to be disconnected from the buckle body 1 by turning the buckle body 1 outwards from the user's body.

Figure 5:
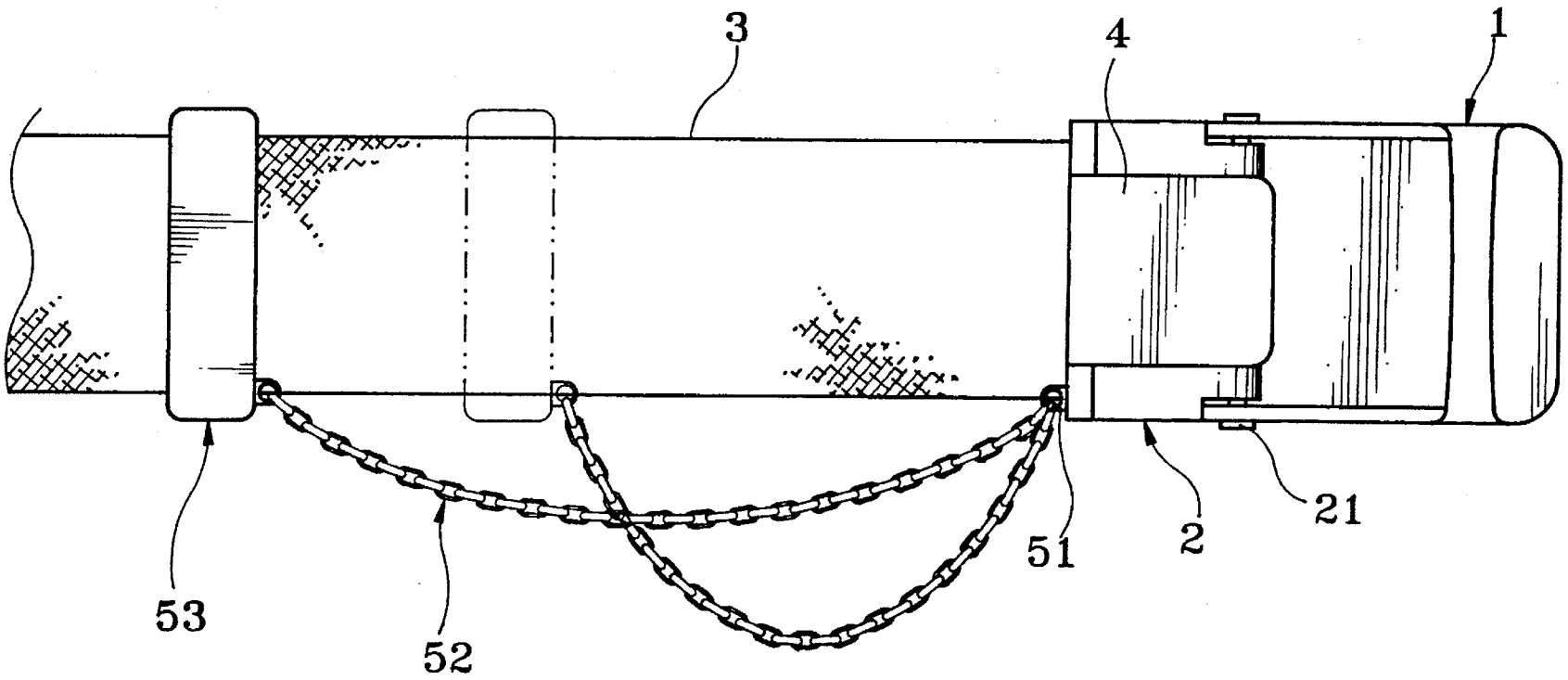
FIG. 5 shows the metal loop connected to the belt catch holder by the chain and moved along the length of the belt.

Referring to FIG. 5, because the metal loop 53 is connected to the belt catch holder 2 by the chain 52, the metal loop 53 is always kept in place.

While only one embodiment of the present invention has been shown and described, it will be understood that various modifications and changes could be made without departing from the spirit and scope or the invention disclosed.

I claim:

1. A belt buckle of the type comprising a belt having a fixed end, a free end, and a longitudinal series of transverse teeth raised from said free end at a back side, a buckle body, a belt catch holder pivotably connected to said buckle body by a first pivot pin, a serrate plate pivotably connected to said belt catch holder by a second pivot pin to hold down the fixed end of said belt, and belt catch means for securing the free end of said belt to said buckle body, wherein said belt catch means comprises:

a recess formed on said belt catch holder through which said first pivot pin passes;

a horizontal rib raised from said belt catch holder above said recess;

a belt catch mounted in said recess and turned about said first pivot pin, said belt catch comprising a stop wall stopped against said horizontal rib, an arched pawl forced into engagement with the transverse teeth of the free end of said belt, a bottom blind hole; and a compression spring mounted within said recess, having one end stopped at a bottom wall inside said recess and an opposite end fastened to the bottom blind hole of said belt catch to render an outward pressure to said belt catch, causing said belt catch to force said pawl into engagement with the transverse teeth of said belt.

2. The belt buckle of claim 1 wherein said belt catch means further comprises a loop for holding the free end of said belt, and a chain connected between said loop and said belt catch holder.

* * * * *